United States Patent [19]

Cooper et al.

[11] Patent Number: 4,457,425

[45] Date of Patent: Jul. 3, 1984

[54] MAGNETIC HOLDER FOR KEYS AND THE LIKE AND METHOD OF MANUFACTURING THE SAME

[75] Inventors: Rosemary J. Cooper, East Longmeadow, Mass. Devineni V. Rotnam, Huntington, N.Y.; Bob O. Beirson, East Longmeadow, Mass.

[73] Assignee: Phelon Magnagrip Co., Inc., East Longmeadow, Mass.

[21] Appl. No.: 487,040

[22] Filed: Apr. 21, 1983

[51] Int. Cl.[3] ..... A45C 11/00; B65D 75/32; G09F 3/18

[52] U.S. Cl. ..... 206/38; 206/818; 206/37; 206/350; 206/820; 206/459; 150/40; 248/206.5; 40/600; 40/621

[58] Field of Search ..... 206/350, 37, 38, 45.34, 206/0.81, 0.82, 459, 820, 818, 484; 150/40; 248/206.5; 40/600, 621

[56] References Cited

U.S. PATENT DOCUMENTS

| | | | |
|---|---|---|---|
| 2,552,699 | 5/1951 | Warfield | 150/40 |
| 2,581,778 | 1/1952 | Young | 206/45.34 |
| 2,589,349 | 3/1952 | Diffenbach | 206/0.81 |
| 3,212,546 | 10/1965 | Lind | 150/40 |
| 3,262,479 | 7/1966 | Leguillon | 150/40 |
| 3,302,678 | 2/1967 | Leguillon | 150/40 |
| 4,037,716 | 7/1977 | Marks | 206/484 |
| 4,236,331 | 12/1980 | Mattson | 40/621 |
| 4,366,637 | 1/1983 | Dechamps | 40/600 |

*Primary Examiner*—William T. Dixson, Jr.
*Attorney, Agent, or Firm*—Chapin, Neal & Dempsey

[57] ABSTRACT

Magnetic holder for keys and the like embodying this invention is in the form of a unitary extrusion of synthetic plastic, magnetic material. The extrusion has a planar web portion, and a key-shaped cut-out is provided through the base portion of said magnetic material. The extrusion includes longitudinal, inwardly opening side edge channels, and the sheet is slidably insertable within said channels as a closure for one side of said key shaped cut-out.

Also disclosed is a method of manufacturing such key holders which includes the steps of extruding a unitary, continuous strip of synthetic plastic magnetic material with a planar web portion and inturned longitudinal edge channels. A key-shaped cut-out is punched through the web portion of the magnetic strip, and a flat panel is fitted over one side of the key-shaped cut-out, with the edges of the panel disposed in said channels.

8 Claims, 5 Drawing Figures

MAGNETIC HOLDER FOR KEYS AND THE LIKE AND METHOD OF MANUFACTURING THE SAME

BACKGROUND OF THE INVENTION

The present invention relates to magnetic keyholders which provide simple, inexpensive and secure means for safely storing or hiding a spare key or the like in any desired location in or about the steel body portions of a vehicle. More particularly, the present invention relates to magnetic keyholders of a thin, flat configuration having an appearance and size similar to that of a business card. In the past, it has been known to provide magnetic type key cases with permanent magnets disposed on one surface of a case or container. The case usually includes a separate cover member slidably fitted onto the case to hold the key securely within the case. One such key case is shown in the Diefenbach Pat. No. 2,589,349. In addition, a molded plastic magnet is shown in U.S. Pat. No. 3,212,546 to Lind. The latter patent shows a tray-like molded plastic magnet into which keys can be fitted for carrying in one's billfold. The magnet means employed feature in the Lind Patent serves the purpose of magnetically holding the key within the recesses formed in the magnetic material. While these prior art keyholders were undoubtedly adequate for their their intended purposes, the holder disclosed in Diefenbach is of relatively complex and expensive construction, while the holder disclosed in Lind is not adapted to be magnetically adhered to the iron surface of a motor vehicle. Moreover, the keyholders disclosed in Lind are individually molded to provide shallow recesses into which the keys are fitted and held magnetically for carrying in one's wallet.

It is the principal object of this invention to provide an improved magnetic holder for keys and the like which can be fabricated by an inexpensive and simple extrusion process.

It is another object of this invention to provide a magnetic holder for keys and the like of the above type, of a simple, generally flat construction, adapted to receive on one surface thereof a sheet on which may be printed any appropriate advertising or promotional information.

The above and other objects and advantages of this invention will be more readily apparent from the following description with reference to the accompanying drawings in which.

Figure 1:
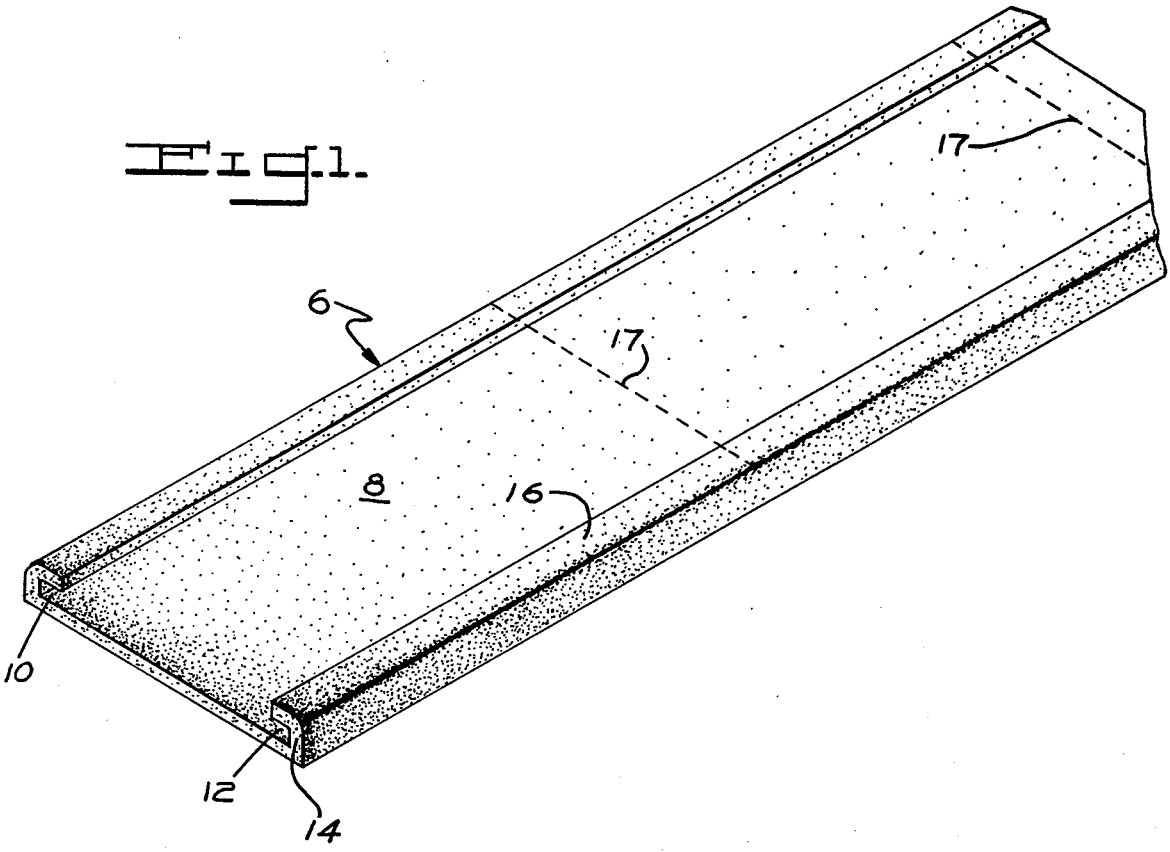
FIG. 1 is a perspective view illustrative of one step in the process of making magnetic holders for keys and the like embodying this invention.
Figure 2:
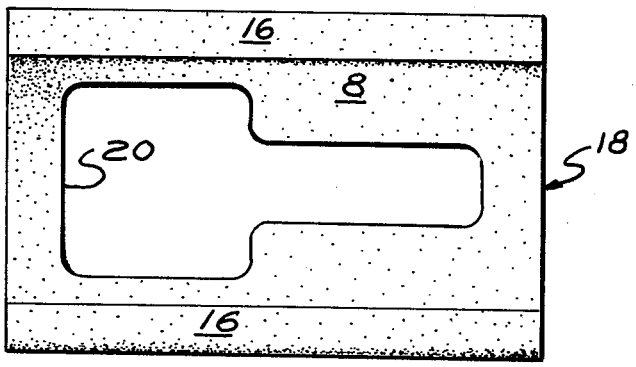
FIG. 2 is a top plan view showing a magnetic holder embodying this invention.

Referring in detail to the drawings, in FIG. 1 is shown a unitary extrusion indicated generally at 6 of a synthetic plastic magnetic material, generally known as a vinyl magnet material. The extrusion is in the form of a generally flat strip of continuous length. The strip includes a planar base or web portion 8 and longitudinally extending side channels 10 and 12. The channels 10 and 12 are formed by upwardly extending wall and an inwardly extending flange portions 14 and 16 respectively. The channels 10 and 12 are of generally U-shaped configuration and open inwardly one toward the other. After extrusion, a continuous length of the strip material as illustrated in FIG. 1 may be severed transversely at spaced locations as indicated at 17 to provide a plurality of individual key holders, one of which is illustrated in FIG. 2. The strip 6 may be cut to provide key holders of one or more varying sizes. At or about the same time as the individual holders are cut from the continuous strip, a cut-out or hole is punched as illustrated at 20 in FIG. 2. The hole 20 is preferably punched at a central location of the web portion 8 or base panel of the magnet strip. The configuration and dimensioning of the cut-out 20 are adequate to accommodate many, if not all of the currently available automobile ignition keys and house keys, one of which is illustrated at 22 in FIG. 3.

After having severed out a keyholder as illustrated in 18 in FIG. 2 and punched the cut-out 20, a retaining sheet 22 (FIG. 4) or panel is provided so that a key will be retained within the holder. The channels 10 and 12 provide the means for securing the retaining card or panel 22 in place against one face of the web portion 8 of the keyholder.

Figure 4:
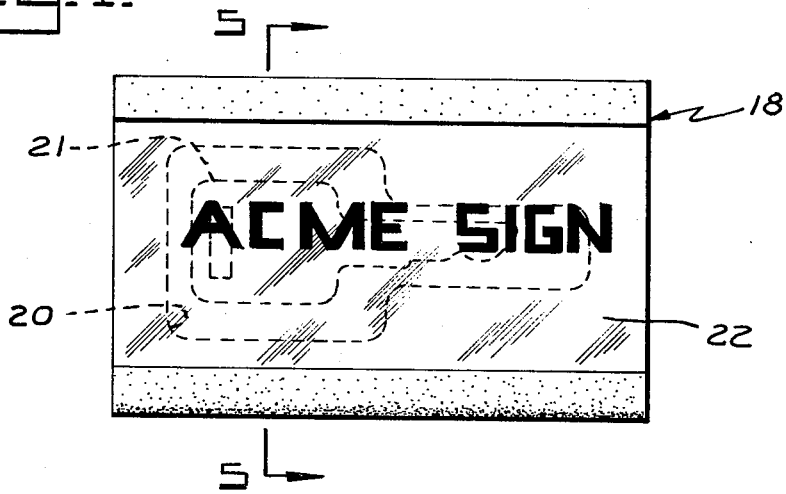
FIG. 4 is a top plan view of the holder.
Figure 5:
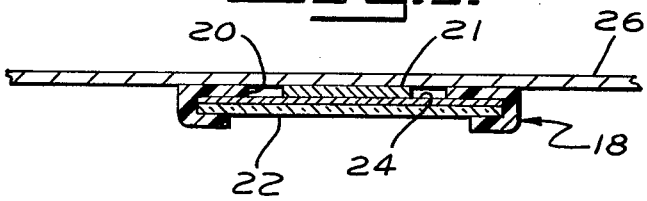
FIG. 5 is a section taken along line 5—5 of FIG. 4.

As best illustrated in FIGS. 4 and 5, a rectangular cover sheet 22 has its outer side edges disposed within the opposed, inwardly opening side channels 10 and 12 of the magnetic strip. With the sheet 22 thus inserted, it will be realized that one side of the cut-out 20 will have been covered or closed by the card or panel 22 held in place thereon by the side channels 10 and 12. Preferably, the panel 22 is in the form of a plastic strip, and this may be used in combination with an inner paper card 24 (FIG. 5) whose surface may be imprinted with any appropriate information or promotional material. The outer sheet 22 is preferably a semi-rigid synthetic plastic material, such as plexiglass or the like, which serves to protect the imprinted surface of the underlying card 24. Of course, the sheets 22 and 24 may be separate or laminated together as may be desirable.

Figure 3:
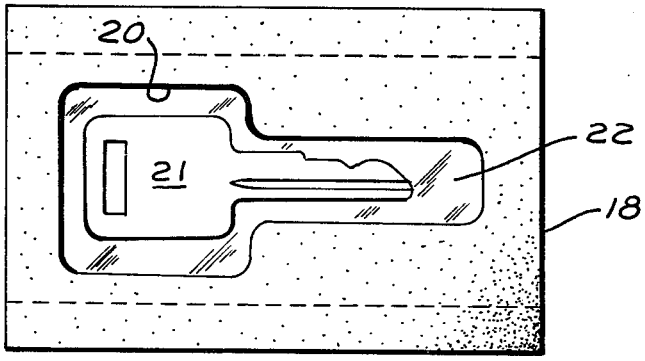
FIG. 3 is a bottom plan view of the holder with a key disposed therein.

As shown in FIG. 5, the keyholder embodied in this invention is used by placing in cut-out 20 a key 21 or any other item which one wishes to hide for emergency use. The outer surface of the magnet strip is provided by the transparent sheet 22, and the composite unit is magnetically affixed onto a ferrous surface 26, such as the under fender of a vehicle or other suitable location. The inner surface of the magnetic keyholder as best shown in FIG. 3 has a relatively large, magnetically active surface area surrounding the keyholder cut-out 20. This large surface insures a a strong magnetic grip against any ferrous surface. Key 21 is thereby securely held in place against the steel panel by the keyholder 18.

As best illustrated in FIG. 5, the keyholder has a relatively flat cross section or low profile and does not protrude to any substantial extent from the panel to which it is magnetically attached, and is hardly noticeable when placed against a steel panel. This flat shape has the added advantage of facilitating the storage, shipment and handling of keyholders embodying this invention. To remove the key from the holder, it is merely necessary with one hand to pull the keyholder outwardly away from the panel to which it is attached, turn it over and simply drop the key into the other hand. The keyholder thus effectively holds the key against any ferrous panel where it is desired without the use of fasteners or adhesives and without the need for using any cover members.

The structural simplicity of the magnetic keyholder embodied in this invention resides primarily in its unitary magnetic holder as best shown in FIG. 2. The holder is an integral extrusion of vinyl magnetic material. It has a through key-hole shaped cut-out opening 20 in the web portion of the strip and includes two integrally formed, inwardly opening side chanels 10 and 12 adapted to slidably receive some type of flat panel to cover over the outer side of the cut-out.

It will be realized that although this unit is primarily adapted to hold an automobile key, it may also be used to hide any other object for emergency use. In this regard, for example, the shape of the slot 20 could be changed so that coins or folding money could be inserted within the opening and adhered to an iron or steel panel as an emergency reserve money supply.

Having thus described this invention, what is claimed is:

1. Magnetic holder for storing a key or other small article by magnetically attaching the holder to a ferrous metal surface comprising an integral strip of magnetic plastic material, said strip including a flat central web portion and inturned side edge channels, said web portion including a cut-out therethrough having a size and shape to accommodate said key or other object when oriented in the plane of said web.

2. Magnetic holder as set forth in claim 1 in which a sheet is disposed against one surface of said web and is retained therein by its edges being fitted into the edge channels of said magnetic plastic strip.

3. Magnetic holder as set forth in claim 1 in which said magnetic plastic strip is an extrusion.

4. Magnetic holder as set forth in claim 2 in which said sheet includes a transparent outer layer for the visual display of indicia imprinted on a card disposed thereunder.

5. Method of manufacturing magnetic holders for the storage of keys and the like by magnetically attaching the holder to a ferrous metal surface, the method comprising the steps of extruding a synthetic plastic magnetic material into a unitary, continous strip having a flat central web portion and longitudinal edge portions which are inturned and form oppositely opening channels, cutting said strip transversely into a plurality of individual holders and making a cut-out through said web portion of a size and shape to accommodate a key or the like when oriented in the plane of said web and inserting against one surface of said web a cover sheet having its edges retained by said edge channels.

6. Method of making magnetic holders as set forth in claim 5 in which said cover sheet is in the form of a transparent layer for the visual display of indicia imprinted on a layer or sheet disposed thereunder.

7. Magnet holder for storing a key or other small article by magnetically attaching the holder onto a ferrous metal surface said holder comprising an extrusion of magnetic plastic material in the form of a planar strip having a cut-out therethrough to accommodate said key or other object when oriented in the plane of said web and a cover sheet affixed onto one surface of said strip to close off one side of said cut-out.

8. Magnet holder as set forth in claim 7 in which said extrusion is an elongated strip with a plurality of longitudinally spaced cut-outs therethrough to accommodate in each a key or other object, said elongated strip being severable transversely to form a plurality of said key holders, said cover sheet including a transparent layer and an opaque inner layer bearing printed indication thereon.

* * * * *